US005363530A

United States Patent [19]

Dunn et al.

[11] Patent Number: 5,363,530

[45] Date of Patent: Nov. 15, 1994

[54] PIPE JOINT CLEANER

[76] Inventors: Jeffery D. Dunn; Starla J. Dunn, both of P.O. Box 1103, Ault, Colo. 80610

[21] Appl. No.: 149,512

[22] Filed: Nov. 9, 1993

[51] Int. Cl.[5] ..... B08B 9/02

[52] U.S. Cl. ..... 15/236.08; 15/104.03; 15/104.04; 15/104.05; 15/104.09; 15/105; 15/236.01; 15/236.05; 15/236.06; 15/236.1; 7/157; 29/81.02; 29/81.021; 29/81.05; 29/81.11; 408/211; 408/227

[58] Field of Search ..... 15/104.02-104.05, 15/104.09, 104.16, 105, 236.01, 236.05, 236.06, 236.08-236.10; 7/100, 157; 81/3.4; 29/81.02, 81.021, 81.05, 81.11; 408/203.5, 211, 227; 51/205 WG; 241/169.1, 199, 293

[56] References Cited

U.S. PATENT DOCUMENTS

| | | | |
|---|---|---|---|
| 1,221,598 | 4/1917 | Roberts | 15/236.08 |
| 1,228,951 | 6/1917 | Morton | 15/105 |
| 1,774,567 | 9/1930 | Raphael | 15/236.06 |
| 2,242,821 | 5/1941 | Fanslow | 81/3.4 |
| 2,629,121 | 2/1953 | Petre | 15/104.03 |
| 3,168,799 | 2/1965 | Johnson | 15/105 |
| 4,103,382 | 8/1978 | Gitt | 15/105 |
| 4,435,873 | 3/1984 | Pool | 15/104.02 |

FOREIGN PATENT DOCUMENTS

| | | | |
|---|---|---|---|
| 19308 | 9/1935 | Australia | 15/104.03 |

*Primary Examiner*—David A. Scherbel
*Assistant Examiner*—Mark Spisich
*Attorney, Agent, or Firm*—Hugh E. Smith

[57] ABSTRACT

A pipe joint cleaner device primarily for plastic pipes which after being cut are to be joined together comprising an open tapered cone member having a plurality of sharp raised projections on both the exterior face of such cone and on the interior face thereof whereby when a cut piece of pipe is inserted into the interior of the cone, in contact therewith, and relative rotation is induced between the pipe and the cone, any burrs or slivers on the exterior end and surface of such pipe are removed by contact with the projections on the interior face of such cone and, conversely, when the tip of the cone is inserted into a cut piece of pipe until firm contact with the exterior of the cone results and again relative rotation takes place, any burrs or slivers on the inside of such pipe end will be removed by the projections on the exterior face of such cone. Due to the cone shape, the device is substantially self-centering, eliminating the need for complicated jigs or the like.

2 Claims, 4 Drawing Sheets

FIG 3
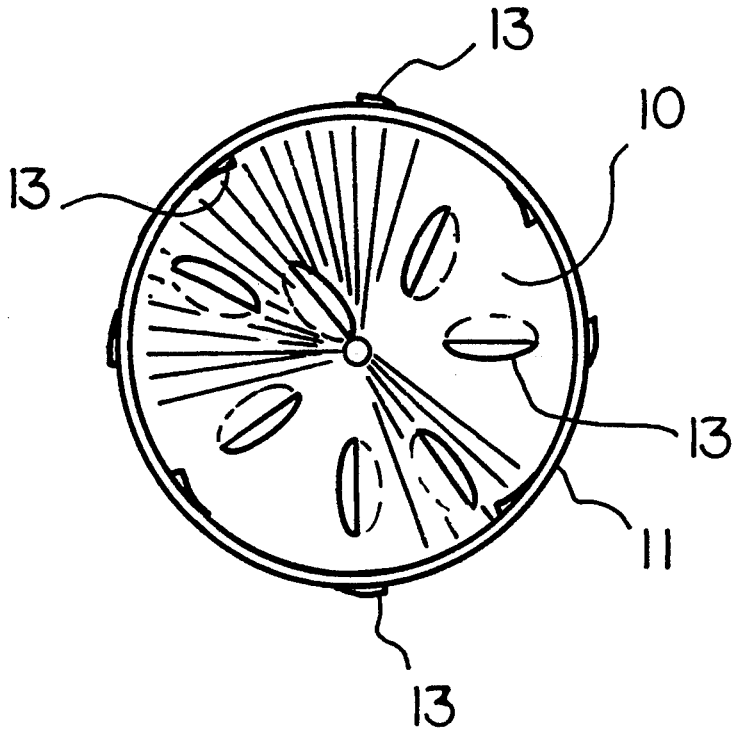
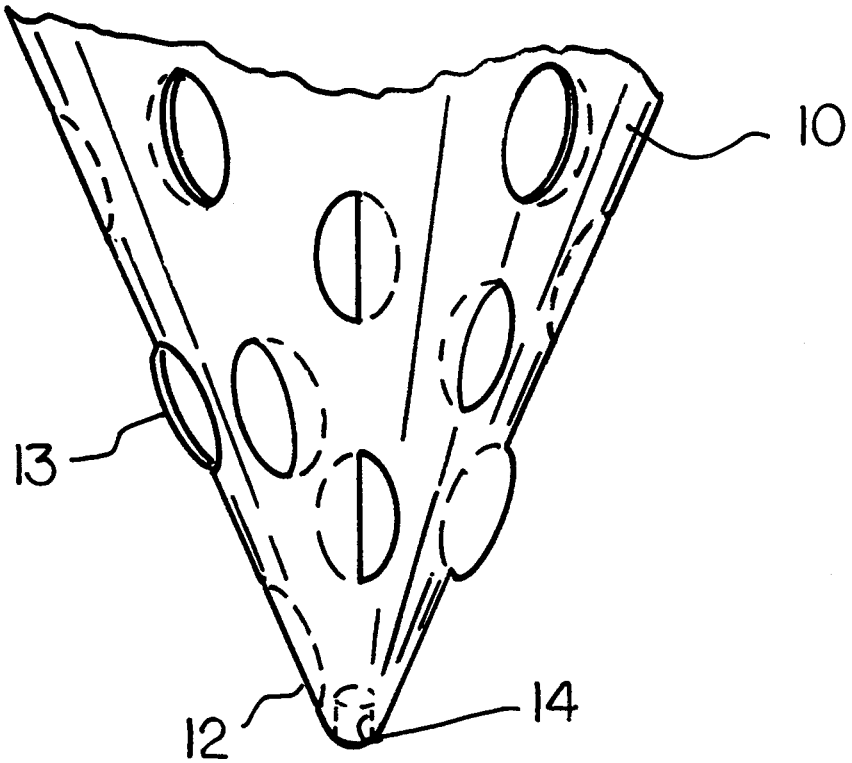
FIG 4

PIPE JOINT CLEANER

BACKGROUND OF THE INVENTION

1. Field of the Invention

The present invention relates to pipe joint cleaners and more particularly pertains to such cleaners which may be used where the pipe is to be joined with another pipe in slip fit.

2. Description of the Prior Art

The use of pipe cleaners is known in the prior art, U.S. Pat. No. 3,752,593 being particularly directed thereto. More specifically, cleaners heretofore devised and utilized for the purpose of cleaning the ends of pipes are known to consist basically of familiar, expected and obvious structural configurations, notwithstanding the myriad of designs encompassed by the crowded prior art which have been developed for the fulfillment of countless objectives and requirements. Generally such cleaners will clean the inside or outside of a pipe but not both. Also such cleaners generally are complex and not adaptable to hand use or use with a simple tool like a power drill.

In this respect, the pipe cleaner according to the present invention substantially departs from the conventional concepts and designs of the prior art, and in so doing provides a single device primarily developed for the purpose of cleaning either the exterior or interior of a piece of cut pipe and yet is simple enough to be hand held if desired.

Typical cutting tools shown in the art, although generally not specific to cleaning pipe for joining are shown in U.S. Pat. Nos. 4,967,854; 4,093,392; and 5,040,930.

Therefore, it can be appreciated that there exists a continuing need for new and improved pipe joint cleaner which can be readily used to clean both the inner and outer surfaces of a cut pipe preparatory to joining. In this regard, the present invention substantially fulfills this need.

SUMMARY OF THE INVENTION

In view of the foregoing disadvantages inherent in the known types of pipe joint cleaners now present in the prior art, the present invention provides an improved cleaner device construction wherein the same can be utilized by hand or be power-driven to clean both the inner and outer surface of a pipe without changing tools. As such, the general purpose of the present invention, which will be described subsequently in greater detail, is to provide a new and improved pipe joint cleaner apparatus which has all the advantages of the prior art devices and none of the disadvantages.

To attain this, the present invention essentially relates to a pipe joint cleaner device primarily for plastic pipes which after being cut are to be joined together comprising an open tapered cone member having a plurality of sharp raised projections on both the exterior face of such cone and on the interior face thereof whereby when a cut piece of pipe is inserted into the interior of the cone, in contact therewith, and relative rotation is induced between the pipe and the cone, any burrs or slivers on the exterior end and surface of such pipe are removed by contact with the projections on the interior face of such cone and, conversely, when the tip of the cone is inserted into a cut piece of pipe until firm contact with the exterior of the cone results and again relative rotation takes place, any burrs or slivers on the inside of such pipe end will be removed by the projections on the exterior face of such cone. Due to the cone shape, the device is substantially self-centering, eliminating the need for complicated jigs or the like.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved pipe joint cleaner which has all the advantages of the prior art devices and none of the disadvantages.

It is another object of the present invention to provide a new and improved pipe joint cleaner which may be easily and efficiently manufactured and marketed.

It is a further object of the present invention to provide a new and improved pipe joint cleaner which is of a durable and reliable construction.

An even further object of the present invention is to provide a new and improved pipe joint cleaner which is susceptible of a low cost of manufacture with regard to both materials and labor, and which accordingly is then susceptible of low prices of sale to the consuming public, thereby making such cleaner units economically available to the buying public.

Still yet another object of the present invention is to provide a new and improved pipe joint cleaner which provides in the apparatuses of the prior art some of the advantages thereof, while simultaneously overcoming some of the disadvantages normally associated therewith.

Still another object of the present invention is to provide a new and improved pipe joint cleaner which is essentially self-centering.

Yet another object of the present invention is to provide a new and improved pipe joint cleaner which may be hand held.

Even still another object of the present invention is to provide a new and improved pipe joint cleaner wherein a single tool may be used to clean either or both of the inner and outer surfaces of a cut pipe end preliminary to joining with another.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a top plan view taken on line 3—3 of FIG. 2 looking down into the device of the present invention.

FIG. 4 is an enlarged plan view of the outer surface of the device of the present invention.

DESCRIPTION OF THE PREFERRED EMBODIMENT

Figure 1:
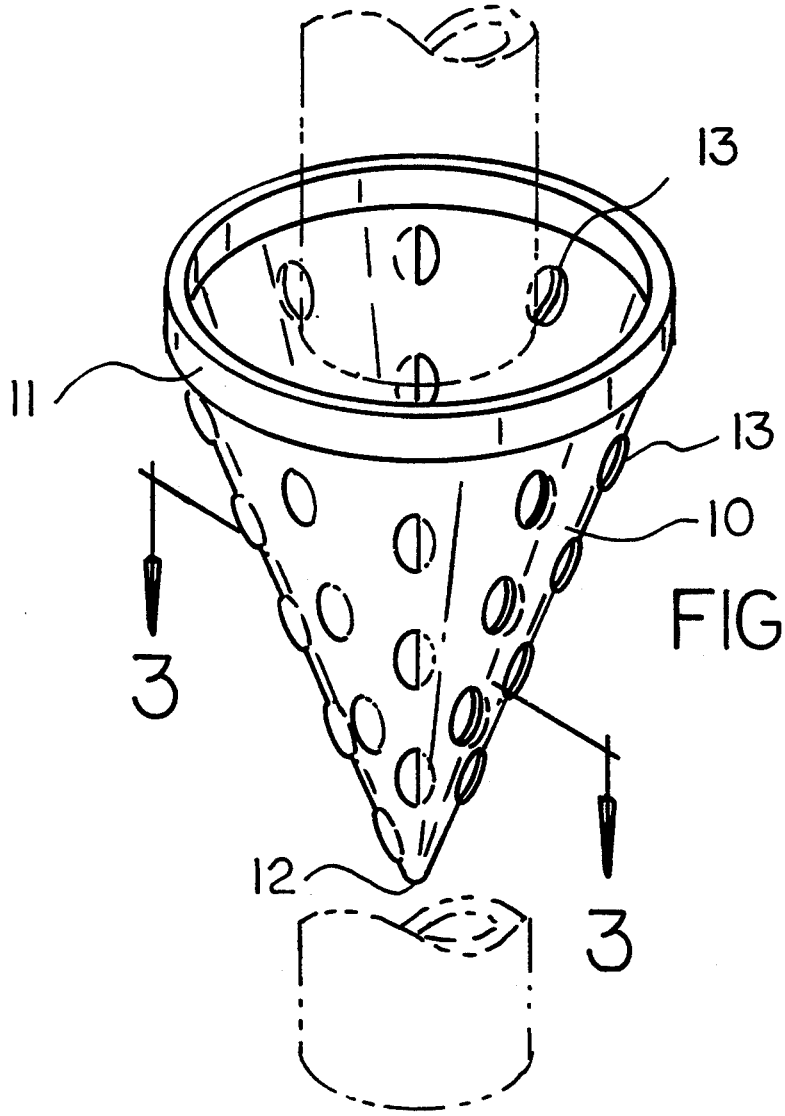
FIG. 1 is a perspective view of the device of the present invention as applied to cleaning the outer surface of a cut pipe end.
Figure 2:
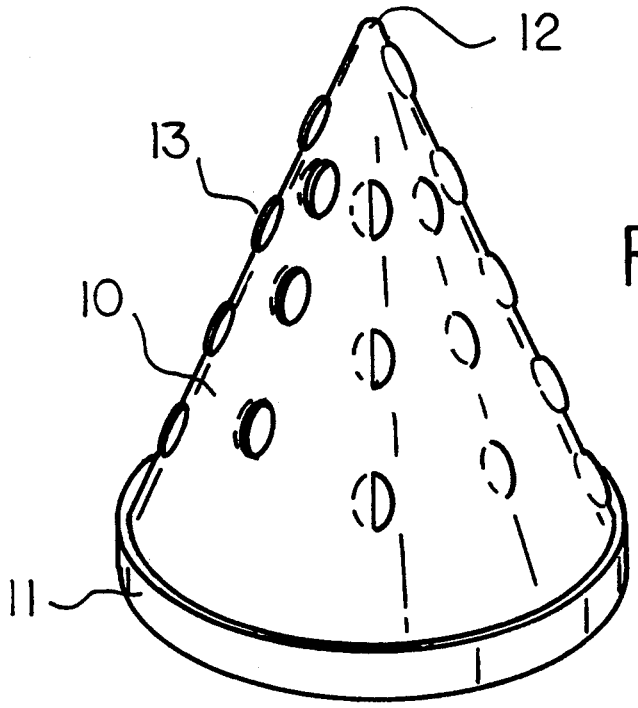
FIG. 2 is a perspective view of the device of the present invention as applied to cleaning the interior surface of a cut pipe end.

With reference now to the drawings, and in particular to FIGS. 1 and 2 thereof, a new and improved pipe joint cleaner embodying the principles and concepts of the present invention and generally designated by the reference numeral 10 will be described.

More specifically, it will be noted that the pipe joint cleaner 10 is an open conically shaped member, tapering from a flat annular ring 11 about the largest periphery portion to a blunt point end 12. Both internally and externally the cone of cleaner 10 carries a multiplicity of cutting projections 13 on the surfaces thereof. These are preferably semi-circular projections formed by stamping a flat sheet from each side and then rolling such sheet into the conical shape shown. The edges of the sheet are secured to each other by welding, brazing, soldering, or the like and ground to produce a smooth seam. A rigid, flat annular ring 11, placed about the widest portion of the cone 10 and secured thereto by welding, adhesive, or the like, also serves to reinforce the securing of the rolled sheet into its conical form. Ring 11 also serves as a hand grip for use in applying and rotating the conical cleaner on a pipe surface to be cleaned. FIG. 1 illustrates the insertion of a cut end of pipe (shown in broken lines) into the interior of the cone 10 wherein, when fully inserted to the point of contact of the pipe end with the sloping walls of cone 10, the projections 13 on the interior walls of cone 10 will cut and abrade away any projecting burrs or slivers from the external end and surfaces of such pipe. Conversely, FIG. 2 illustrates the insertion of the pointed end 12 of cone 10 into a cut pipe (again shown in broken lines) wherein the projections 13 on the outer surface of cone 10 will similarly clean up burrs, etc on the inside surface of such pipe.

FIG. 3 looking down into the cone 10 more clearly shows the extent of projections 13 from the inner and outer surfaces of cone 10. FIG. 4 is enlarged to show such projections 13 from the outer surface of cone 10 and illustrates providing an opening 14 in the tip 12 of cone 10 to permit debris from the cleaning of the outer surface of a pipe as shown in FIG. 1 to be discharged from the cone 10 while in use.

Figure 5:
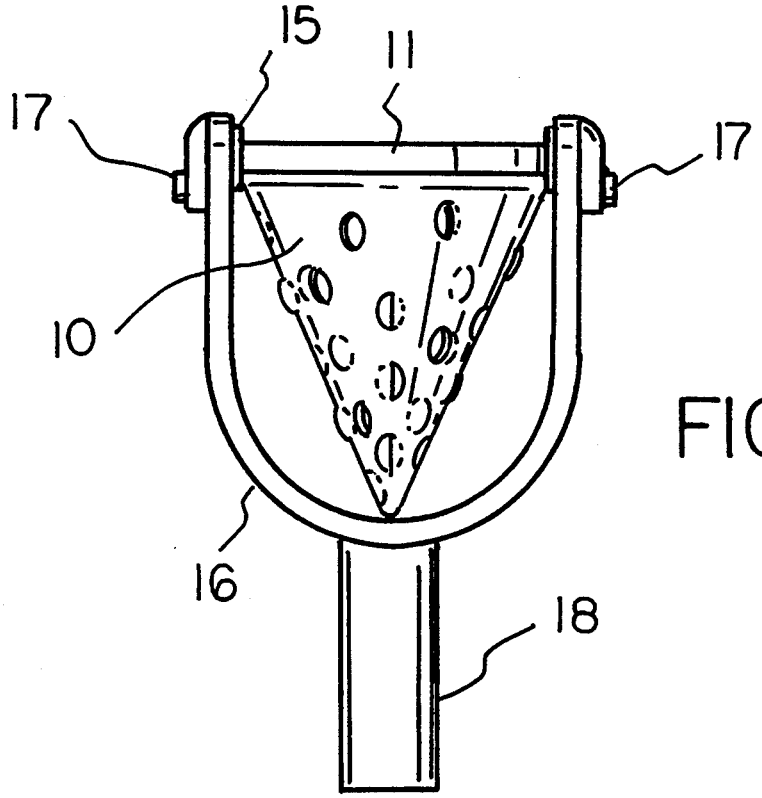
FIG. 5 is a front plan view of a modification of the present invention adapted for external pipe surface cleaning.
Figure 6:
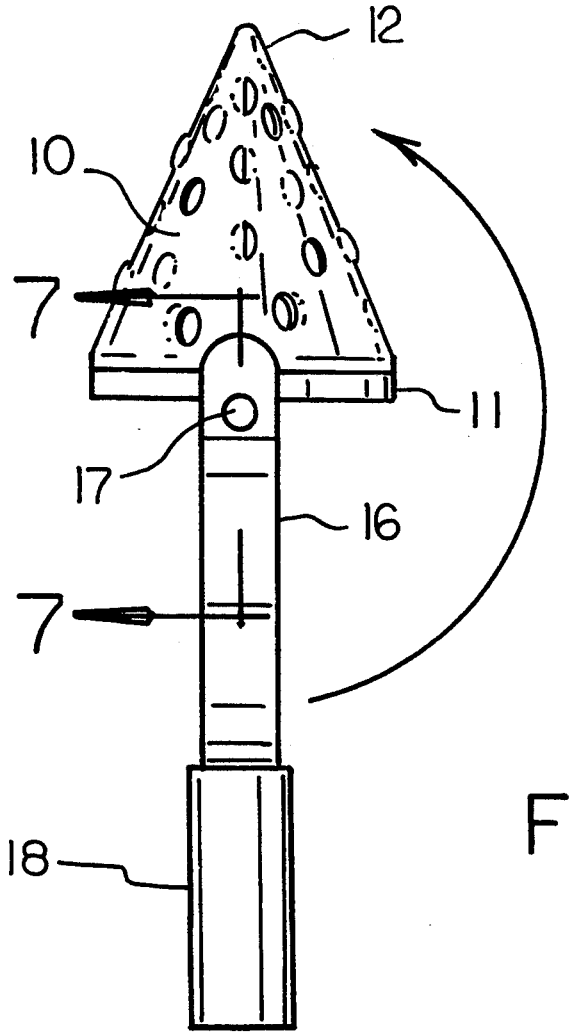
FIG. 6 is a similar view to FIG. 5 showing the device adapted for internal cleaning of a pipe joint surface.

FIGS. 5 and 6 illustrate the mounting of the pipe cleaner 10 to permit driving such cleaner 10 mechanically. Utilizing the annular ring 11, a rotatable swivel stud 15 is fixedly secured to diametrically opposite sides thereof with the stud 15 engaging in the arms of a yoke 16. As more clearly shown in FIGS. 7 and 8, a spring-loaded detent pin 17 on each yoke arm engages with stud 15 to hold it in one of two fixed positions. As shown in FIG. 5, the stud 15 is positioned so that the attached ring 11 and associated cone 10 are firmly held within said yoke 16 with the wide open end of cone 10 facing upwards to receive a cut pipe end therein in similar fashion to that shown in FIG. 1. By pulling the detent pins 17, cone 10 is permitted to rotate within yoke 16 to present the pointed end 12 in an upwardly extending position. Yoke 16 is supported at its closed end by a handle or shaft 18. If desired to machine drive the cone 10, shaft 18 may be engaged with the chuck of a power tool (not shown).

Figure 7:
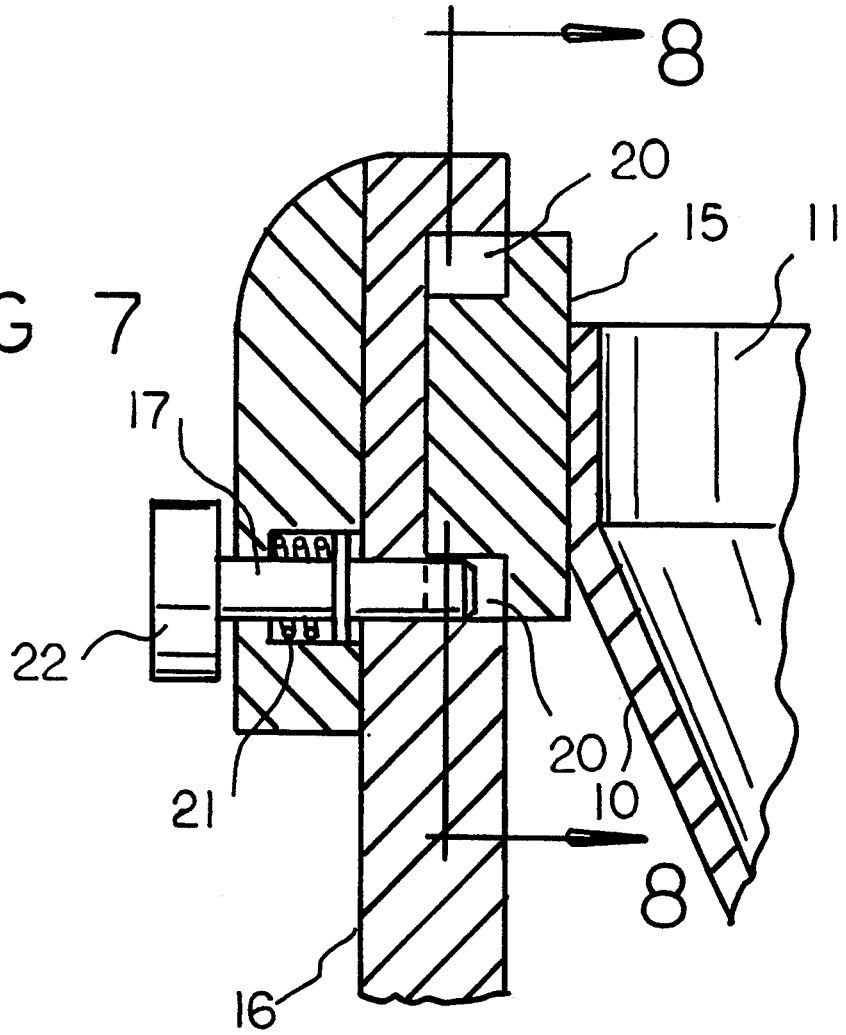
FIG. 7 is a sectional view on line 7—7 of FIG. 6.
Figure 8:
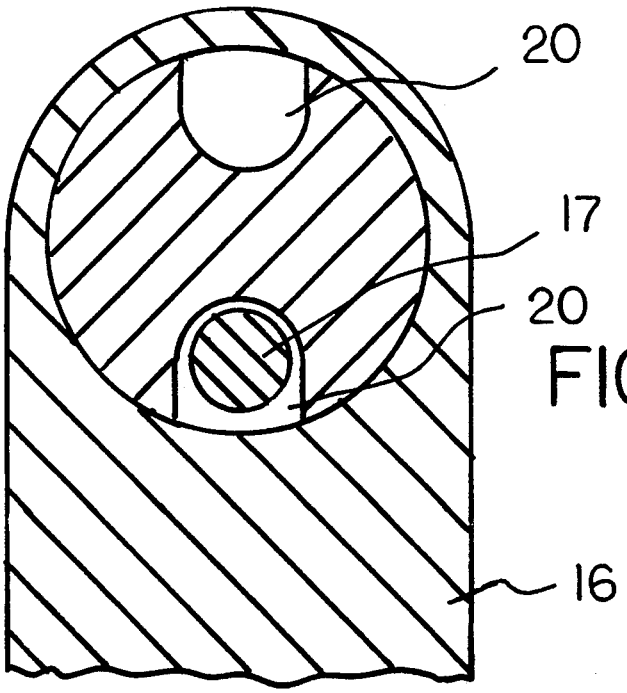
FIG. 8 is a sectional view on line 8—8 of FIG. 7.

FIGS. 7 and 8 are sectional views showing the details of studs 15 and detents 17. A recess 20 is provided at top and bottom of stud 15 to engage the detent 17 which may be pulled out against the resistance of spring 21 by grasping knob 22 at the end of detent 17. Upon rotation of cone 10, the detent 17 will snap into place when it engages with the other recess 20 at which point cone 10 will be inverted from its initial position.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pipe joint cleaner, particularly suitable for cleaning the cut ends of a plastic pipe preparatory to joining, which comprises:

a hollow rigid conical member having an open wide end, an interior surface, and an exterior surface; a plurality of sharp cutting projections extending from both the interior and the exterior surfaces of said conical member; and means to rotate said conical member with said projections in contact with a pipe to be cleaned, wherein said means comprises an annular ring secured to said conical member about said open wide end, and wherein said means further comprises a two-arm yoke having a demanding handle portion, with said yoke being mounted to diametrically opposed sides of said annular ring.

2. A cleaner as in claim 1, wherein said depending handle portion is engagable to a chuck of a power tool.

* * * * *